US006389964B1

(12) United States Patent
Ohkawa

(10) Patent No.: US 6,389,964 B1
(45) Date of Patent: May 21, 2002

(54) STENCIL PRINTER

(75) Inventor: Eiji Ohkawa, Miyagi (JP)

(73) Assignee: Tohoku Ricoh Co., Ltd., Shibata-gun (JP)

( * ) Notice: Subject to any disclaimer, the term of this patent is extended or adjusted under 35 U.S.C. 154(b) by 0 days.

(21) Appl. No.: 09/516,941

(22) Filed: Mar. 1, 2000

(30) Foreign Application Priority Data

Apr. 28, 1999 (JP) ..... 11-122397
Oct. 13, 1999 (JP) ..... 11-291014

(51) Int. Cl.[7] ..... B41L 13/04
(52) U.S. Cl. ..... 101/116; 101/126
(58) Field of Search ..... 101/114, 116, 101/119, 120, 126, 129, 153

(56) References Cited

U.S. PATENT DOCUMENTS

| | | | | |
|---|---|---|---|---|
| 5,843,560 A | | 12/1998 | Ohta et al. | |
| 5,908,687 A | | 6/1999 | Mori | |
| 5,937,750 A | * | 8/1999 | Takeda | 101/116 |
| 6,019,036 A | | 2/2000 | Ohkawa | |
| 6,101,935 A | * | 8/2000 | Ohkawa | 101/116 |
| 6,129,013 A | * | 10/2000 | Takasawa et al. | 101/114 |

FOREIGN PATENT DOCUMENTS

| | | |
|---|---|---|
| JP | 54-033117 | 3/1979 |
| JP | 3-193445 | 8/1991 |
| JP | 4-007198 | 1/1992 |
| JP | 4-105983 | 4/1992 |
| JP | 4-185377 | 7/1992 |
| JP | 5-070595 | 10/1993 |
| JP | 8-058216 | 3/1996 |
| JP | 8-332785 | 12/1996 |
| JP | 9-058104 | 3/1997 |
| JP | 10-230690 | 9/1998 |

* cited by examiner

*Primary Examiner*—Ren Yan
(74) *Attorney, Agent, or Firm*—Oblon, Spivak, McClelland, Maier & Neustadt, P.C.

(57) ABSTRACT

A stencil printer of the present invention includes a porous hollow cylindrical print drum rotatable with a perforated master having a porous resin film as a base wrapped therearound. A pressing member is selectively movable into or out of contact with the print drum for pressing a paper or similar recording medium fed from a paper feeding device against the print drum. As a result, ink is transferred from the inside of the print drum to the paper via perforations formed in the master. The pressing member is implemented as a roller having a plurality of layers including an inner layer having a hardness of 8° to 14° (JIS (Japanese Industrial Standards)-A) and an outer layer having a hardness of 30° to 40° (JIS-A). With this configuration, the entire roller has surface hardness of 18° (JIS-A) and prevents the resin film of the stencil from partly coming off due to stress ascribable to the edges of relatively thick papers.

24 Claims, 9 Drawing Sheets

Fig. 9

| SURFACE RUBBER HARDNESS (JIS-A) | RUBBER HARDNESS (INNER) (JIS-A) | RUBBER HARDNESS (OUTER) (JIS-A) | RUBBER THICKNESS (OUTER) t (mm) | NIP WIDTH x (mm) | SURFACE PRESSURE (kg/cm$^2$) | COME-OFF OF RESIN FILM |
|---|---|---|---|---|---|---|
| 30 | 10 | 30 | 2.3 | 2.0 | 2.5 | × |
| 27 | | | 1.8 | 2.3 | 2.2 | × |
| 25 | | | 1.5 | 3.0 | 1.7 | × |
| 22 | | | 1.2 | 3.7 | 1.4 | × |
| 20 | | | 1.0 | 4.3 | 1.2 | ○ |
| 18 | | | 0.8 | 5.1 | 1.0 | ◎ |
| 15 | | | 0.5 | 6.2 | 0.8 | ◎ |
| 14 | | | 0.4 | 6.5 | 0.7 | ☆ |
| 10 | | | 0 | 8.0 | 0.6 | ☆ |
| 21 | 4 | 30 | 1.2 | 4.0 | 1.3 | × |
| 18 | | | 1.0 | 4.6 | 1.1 | ◎ |
| 15 | | | 0.8 | 5.9 | 0.8 | ◎ |
| 14 | | | 0.7 | 6.4 | 0.7 | ☆ |
| 21 | 8 | 40 | 1.0 | 3.9 | 1.4 | × |
| 18 | | | 0.8 | 4.6 | 1.1 | ◎ |
| 20 | 8 | 30 | 1.2 | 4.2 | 1.2 | ○ |
| 18 | | | 1.0 | 4.5 | 1.1 | ◎ |
| 15 | | | 0.8 | 6.0 | 0.9 | ◎ |
| 14 | | | 0.6 | 6.5 | 0.8 | ☆ |
| 22 | 14 | 40 | 0.8 | 3.9 | 1.3 | × |
| 18 | | | 0.5 | 5.0 | 1.0 | ◎ |

Fig. 11

| SURFACE RUBBER HARDNESS (JIS-A) | FOAM HARDNESS (ASCAR C) | RUBBER HARDNESS (OUTER) (JIS-A) | RUBBER THICKNESS (OUTER) t (mm) | COME-OFF OF RESIN FILM |
|---|---|---|---|---|
| 25 | 25 | 30 | 1.5 | × |
| 22 | | | 1.2 | × |
| 20 | | | 1.0 | ○ |
| 18 | | | 0.8 | ◎ |
| 15 | | | 0.5 | ◎ |
| 14 | | | 0.4 | ☆ |
| 21 | 20 | 30 | 1.2 | × |
| 18 | | | 1.0 | ○ |
| 15 | | | 0.8 | ◎ |
| 14 | | | 0.7 | ☆ |
| 20 | 20 | 40 | 1.2 | × |
| 19 | | | 1.0 | ○ |
| 15 | | | 0.7 | ◎ |
| 14 | | | 0.6 | ☆ |
| 21 | 30 | 30 | 1.0 | × |
| 19 | | | 0.8 | ○ |
| 22 | 30 | 40 | 0.8 | × |
| 18 | | | 0.5 | ◎ |

STENCIL PRINTER

BACKGROUND OF THE INVENTION

The present invention relates to a stencil printer.

Stencils for thermal printing include one having a thermoplastic resin film, a porous thin sheet or similar base permeable to ink and adhered to the resin film, and an anti-stick layer formed on the resin film for preventing the film from sticking to a thermal head. The porous sheet is, in many cases, implemented by flax fibers or a mixture of flax fibers, synthetic fibers, and wood fibers.

The above conventional stencil, however, has the following problems (a) and (b) left unsolved because the fibrous base just overlies the resin film.

(a) A great amount of adhesive gathers in the from of webs in regions where the overlapping portions of fibers and the resin film contact each other, obstructing the perforation of the stencil by the thermal head.

(b) Fibers themselves check the passage of ink and make printing irregular.

To solve the above problems (a) and (b), some different stencils for thermal printing have been proposed in the past. Japanese Patent Laid-Open Publication No. 3-193445, for example, teaches a porous thin sheet or base implemented by fibers as thin as 1 denier. This kind of base solves the problem (b), but cannot solve the problem (a).

Japanese Patent Laid-Open Publication No. 4-7198 discloses a printing method using a stencil produced by applying a mixture solution of fine particles of polymer dispersion and colloidal silica to the surface of a film and then drying it to form a porous layer. The stencil is perforated by a master making machine Print Gokko (trade name) available from Riso Kagaku Corporation to thereby make a master. The master is used to print images on papers with ink HG-4800 available from EPSON. The above porous layer, however, does not allow ink to smoothly pass therethrough and cannot implement satisfactory image density when use is made of conventional ink for thermal printing. Moreover, the porous layer itself lacks a sufficient heat insulating ability and prevents the stencil from being desirably perforated.

Japanese Patent Laid-Open Publication No. 54-33117 proposes a stencil consisting substantially only of a heat-sensitive resin film, i.e., not including a base. While this kind of stencil solves the previously stated problems (a) and (b) at the same time, it brings about other problems, as will be described hereinafter.

When the film constituting the stencil is 10 $\mu$m thick or less, the stencil fails to have sufficient stiffness and cannot be easily conveyed. In light of this, Japanese Patent Publication No. 5-70595 proposes to wrap an elongate film around a print drum without cutting it and cause the entire film to rotate together with the print drum during printing. This scheme, however, increases the turning moment because the film and a master attaching and detaching unit rotate together with the print drum during printing. This, coupled with the noticeable offset of the center of gravity from the axis of rotation, requires a printer to have a heavy, bulky configuration.

On the other hand, when the film is 5 $\mu$m thick or more, its heat sensitivity is reduced and obstructs perforation by the thermal head. Moreover, heat applied from heating means is transferred to a platen via the stencil and lost in a substantial amount, limiting energy available for the perforation of the film. Japanese Patent Laid-Open Publication No. 10-230690 discloses a stencil made up of a thermoplastic resin film and a porous resin film or base provided on one surface of the resin film, i.e., a stencil without a filler.

Specifically, the porous resin film included in the above stencil is formed by precipitating a resin solved in a solvent and, e.g., solidifying it. Comparing the film to a floor, the porous resin film is a wall-like film implemented as an assembly of a number of cells with or without a ceiling, a foam-like film implemented by an assembly of open cells, or a film implemented by an assembly of resin in the form of particles or fibers. The cells may be fully closed or partly open. Openings appear on the surface of the porous resin due to the bursting of cells occurring in the drying step.

Open cells, a resin in the form of particles or fibers and cells without a ceiling, which constitute the porous resin film in combination, are connected together. This configuration provides the resin film with sufficient tensile strength and stiffness and thereby provides the stencil with sufficient tensile strength while allowing it to be smoothly conveyed.

Generally, the porous resin film has a mean cell size of 1 $\mu$m or above, but 50 $\mu$m or below. Mean cell sizes less than 1 $\mu$m obstruct the smooth passage of ink. Should ink with low viscosity be used to allow it to pass through the resin film in a sufficient amount, it would blur images and would ooze out from the sides of the print drum and the trailing edge of a master wrapped around the drum. In addition, the void content of the resin film would decrease and would therefore further obstruct the perforation by the thermal head.

Mean cell sizes greater than 50 $\mu$m reduce the ink regulating effect available with the porous resin film. As a result, ink is forced out from the print drum to a paper or similar recording medium in an excessive amount, smearing the rear surfaces of papers and blurring images.

The porous resin film should only have a number of voids therein side and on the surface thereof. To promote the passage of ink, the voids should preferably be communicated to each other in the direction of thickness of the film and extend, comparing the film to the floor, throughout the ceiling. Alternatively, at the boundary between the porous resin film and the thermoplastic resin film, the former may cover the latter so long as it does not obstruct perforation by the thermal head. The resin constituting the porous resin film so covering the thermoplastic resin film should generally be 7 $\mu$m thick or less inclusive of the thermoplastic resin film, although dependent on the kind of the resin, heat sensitivity of the thermoplastic resin film, etc.

The total area of openings having diameters of 5 $\mu$m or above in terms of a true circle, as measured on the surface of the porous resin film, is 4% to 80%, preferably 10% to 60%, of the entire surface area. If this radio is less than 4%, the resin film is apt to obstruct the perforation by the thermal head and the passage of ink. If the ratio is greater than 80%, the tensile strength and stiffness of the resin film decrease.

The porous resin film is entirely different in structure from the conventional porous portion of a stencil for thermal printing. Specifically, solid portions included in the porous resin film have various shapes including a rod-like shape, a spherical shape and a branch-like shape. The configuration of the solid portions is determined by conditions for the fabrication of the resin film, e.g., the kind of the resin, the solid content of a liquid, the kind of a solvent, the amount of deposition of a resin solution, the temperature of the resin solution, temperature for drying the resin solution, and ambient temperature and humidity for application. Among them, the temperature of the resin solution and ambient temperature and humidity for application have critical influence on the configuration of the solid portions.

For example, when the temperature of the resin solution is 10° C. or below, the resin solution easily gels and is difficult to apply. Conversely, when the above temperature exceeds 30° C., it is difficult to form the porous resin film. It follows that the temperature for application should also preferably be between 10° C. and 30° C. The ambient humidity for application above 50% RH would cause the surface of the thermoplastic resin film to adsorb a great amount of water and would thereby lower wettability with respect to the solution, weakening adhesion between the porous resin film and the thermoplastic resin film.

The stencil with the above porous resin film realizes attractive images when used with a stencil printer PREPORT VT3820 (trade name) available from Ricoh Co., Ltd. and ink VT60011 (lot No. 960604-22) (trade name) for PREPORT and when perforated and used for printing (three printing speeds) in a 20° C., 60% RH environment with a 7% greater pulse width than in the standard state. Images are attractive when image density is 0.7 to 1.3, preferably 0.9 to 1.25, as measured by a densitometer RD914 available from Macbeth. The porous resin film is clearly distinguishable in structure from the resin film of Laid-Open Publication No. 4-7198 mentioned earlier. The above ink for PREPORT has viscosity of 150 Poise at 20° C., as measured by a densitometer HAAKE CV20 and a rotor PK 30-4 at a share rate of 20 (1/S).

When ink for an ink jet printing system is applied to the master including the porous resin film, it is transferred to a paper in an excessive amount and blurs the resulting image.

The total area of openings having diameters of 5 $\mu$m or above in terms of a true circle, as measured on the surface of the porous resin film, is 50% or above, but 70% or below, of the entire opening area. If this radio is less than 50%, the resin film is apt to obstruct the perforation by the thermal head and the passage of ink.

The porous resin film or base has a thickness between 5 $\mu$m and 100 $\mu$m, preferably between 6 $\mu$m and 50 $\mu$m. Thickness less than 5 $\mu$m cannot implement sufficient film strength and makes it difficult for the porous resin film to remain at the rear of perforated portions. This renders control over the amount of ink transfer impracticable and aggravates the smearing of the rear of surfaces of prints. Thickness greater than 100 $\mu$m is apt to obstruct the passage of ink. The regulation of the amount of ink transfer available with the porous resin film is more promoted as the film thickness increases, so that the amount of ink transfer to a paper can be controlled in terms of the thickness of the above film. When the thickness after the application is greater than the target value, the porous resin film can be thinned to the target value by a calender or similar suitable means.

When the mean cell size of the porous resin film is 20 $\mu$m or less, the passage of ink is more obstructed as the thickness of the resin film increases. It is therefore possible to control the amount of ink transfer to a paper on the basis of the thickness of the porous resin film. The thickness should preferably be uniform; otherwise irregular printing occurs. The thickness is measured without any substantial load or with an extremely light load.

The amount of deposition of the porous resin film or base ranges from 0.5 g/m$^2$ to 25 g/m$^2$, preferably 2 g/m$^2$ to 15 g/m$^2$. Amounts greater less than 0.5 g/m$^2$ prevent the porous resin film from having sufficient strength while amounts greater than 25 g/m$^2$ obstruct the passage of ink and thereby degrade image quality.

The porous resin film has density between 0.01 g/cm$^3$ and 1 g/cm$^3$, preferably between 0.1 g/cm$^3$ and 0.5 g/cm$^3$. Density below 0.01 g/cm$^3$ prevents the resin film from having sufficient strength while density above 1 g/cm$^3$ obstructs the passage of ink and thereby degrades image quality. A master for thermal printing should preferably have stiffness of 5 mN or above in terms of bending rigidity, as measured by Lorentzen stiffness tester. Bending rigidity below 5 mN makes the conveyance of the stencil on the printer difficult.

When the thermoplastic resin film of the above stencil is perforated by 20% in terms of the open ratio, air flows through the resin film at a range of 1.0 cm$^3$/cm$^2$ sec to 157 cm$^3$/cm$^2$ sec, as measured by a permeability tester. The above open ratio refers to, when a solid image is formed in a stencil for thermal printing by, e.g., a thermal head, a laser or a flash lamp, the ratio of the total area of through holes formed in the thermoplastic film of the stencil to the unit area of the solid image.

When the open ratio is less than 20%, ink with extremely low viscosity must be used in order to guarantee desired image density. This kind of ink deteriorates the uniformity of a solid image and the reproducibility of thin lines when it comes to a stencil printing system. When permeability is less than 1.0 cm$^3$/cm$^2$ sec, the passage of ink is deteriorated; ink with low viscosity used for implementing a sufficient amount of ink transfer would blur an image and would be forced out from the sides of the print drum and the trailing edge of the master wrapped around the drum. Moreover, the above permeability often reduces the void content of the porous resin film and obstructs the perforation by the thermal head.

Permeability above 157.0 cm$^3$/cm$^2$ sec degrades the ink regulating effect available with the porous resin film and causes ink to be forced out from the print drum to a paper in an excessive amount and brings about offset and blurring.

To render the perforation of the thermoplastic resin film by the thermal head more effective, at least part of the porous resin film contacting the thermoplastic resin film should preferably soften at 150° C. or below.

To print an image on a paper, ink is passed through perforations formed in the thermoplastic resin film by the thermal head. Ink cannot be passed through closed cells. However, this problem is solved because ink for use in a thermal stencil printer is generally a W/0 emulsion and because the film structure of the porous resin film is partly destroyed by the above components. Cells should preferably be not closed.

To form cell, use may be made of substances that do not exhibit the above characteristic alone, but exhibit it when combined. If desired, part of the film may be destroyed either mechanically or chemically during or after the formation of cells. In practice, to produce a stencil for thermal printing, it is preferable to form a porous resin film formed of foam on a thermoplastic resin film.

For the major component of the porous resin film, there may be used any one of plastics including polyethylene, polypropylene, polybutene, styrene resin, polyvinyl chloride, polyvinylidene chloride, polyvinyl alcohol, polyvinyl acetate, polyvinyl butyral, polyvinyl acetal, vinyl chroride-vinyl acetal copolymer, vinyl chloride-vinylidene chloride copolymer, vinyl chloride-acrylonitrile copolymer, styrene-acrylonitrile copolymer and other vinyl resins, polyacrylonitrile, polyacrylic acid plastics, diene plastics, polybutylene, nylon and other polyamides, polyester, polyphenylene oxide, (meta)acrylic acid ester, polycarbonate, polyacetal, fluorocarbon resin, polyurethane plastics, natural plastics, natural rubber plastics, thermoplastic elastomers, acetyl cellulose, acetylbutyl cellulose, acetylpropyl cellulose andother cellulose derivatives and other microbial plastics, and copolymers containing such polymers. Use may also be made of various fatty acids, waxes and other carbohydrates, and various proteins.

To form the porous resin film of the stencil, there may be effected steps of applying a fluid resin solution (composition) containing foam, a fluid resin solution (composition) containing one of two or more components which generate a gas on contacting each other or a fluid resin solution (component) in which a gas is dissolved at 1 atmosphere or above to the thermoplastic resin film and then drying it.

The stencil with the above porous resin film is free from the problems (a) and (b). However, there arises another problem that when relatively thick papers are used, their edges contact the same portion of the stencil or master wrapped around the print drum. This, coupled with the fact that a press roller presses such papers against the print drum, stress acts on the master. As a result, the porous resin film partly comes off the thermoplastic resin film and remains on the print drum in the form of a small piece. This piece remains on the print drum even after the master is replaced with a new master. At the time of the next printing executed with the new master wrapped around the print drum, the above piece left on the print drum blocks ink and thereby causes an image to be locally lost.

Technologies relating to the present invention are also disclosed in, e.g., Japanese Patent Laid-Open Publication Nos. 4-105983, 4-185377, 8-58216, 8-332785 and 9-58104 and U.S. Pat. Nos. 5,843,560 and 5,908,687.

SUMMARY OF THE INVENTION

It is therefore an object of the present invention to provide a stencil printer capable of preventing a porous resin film or base forming part of a master wrapped around a print drum from partly coming off and remaining on the drum when use is made of relatively thick papers, thereby obviating the local omission of an image.

A stencil printer of the present invention includes a porous hollow cylindrical print drum rotatable with a perforated master having a porous resin film as a base wrapped therearound. A pressing member is selectively movable into or out of contact with the print drum for pressing a recording medium fed from a medium feeding device against the print drum. As a result, ink is transferred from the inside of the print drum to the recording medium via perforations formed in the master. The pressing member is implemented as a roller having surface hardness of 18° or less (JIS (Japanese Industrial Standards)-A). Alternatively, the pressing member may be implemented as a roller having surface hardness of less than 15° (JIS-A).

BRIEF DESCRIPTION OF THE DRAWINGS

The above and other objects, features and advantages of the present invention will become more apparent from the following detailed description taken with the accompanying drawings in which:

FIG. 9 is a table listing experimental results particular to the present invention;

FIG. 11 is a table listing other experimental results particular to the present invention.

DESCRIPTION OF THE PREFERRED EMBODIMENTS

Figure 1:
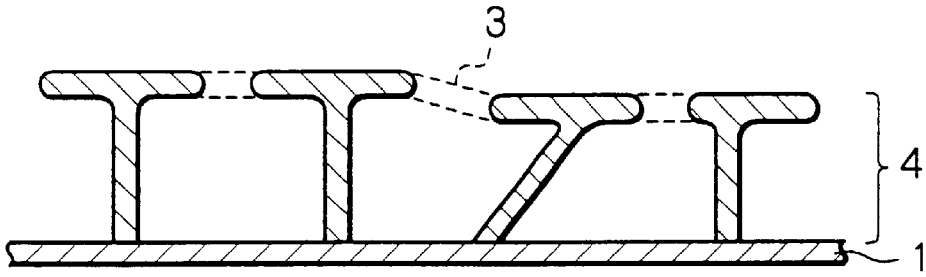
FIGS. 1 through 3 are sections showing a porous resin film.

To better understand the present invention, brief reference will be made to a conventional heat-sensitive stencil including a porous resin film, but not including a filler, shown in FIG. 1. As shown, the conventional stencil includes a thermoplastic resin film 1 and a porous resin film 4 having openings 3.

Figure 2:
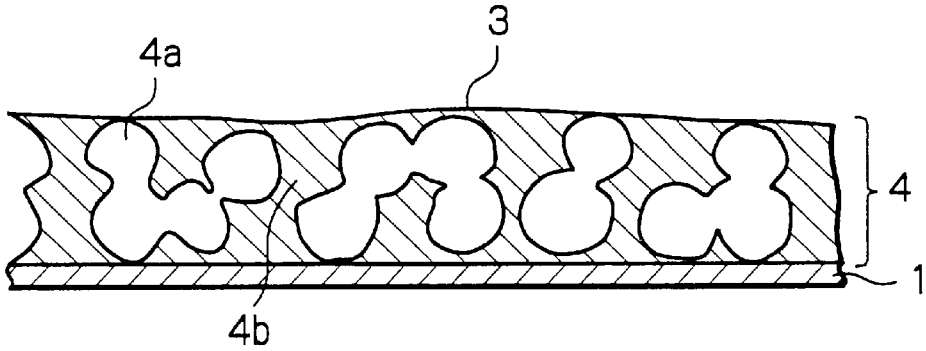
Figure 3:
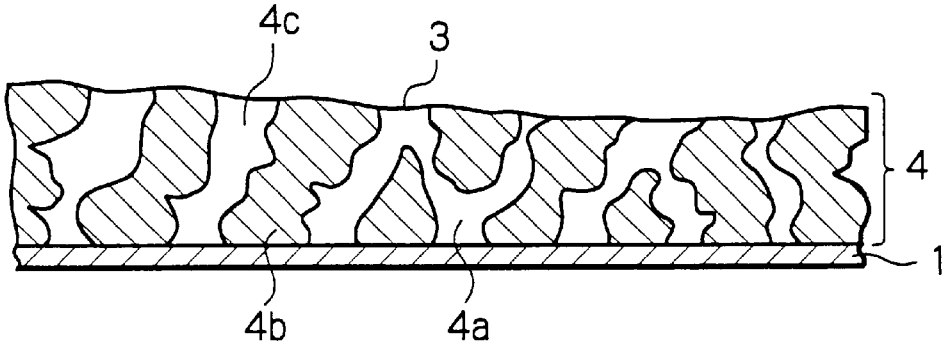

As shown in FIGS. 2 and 3, the porous resin film 4 is made up of open cell 4*a*, a resin 4*b* implemented as particles or fibers, and cells 4*c* without a ceiling. The open cells 4*a*, resin 4*b* and cells 4*c* are connected together. This configuration provides the porous resin film 4 with sufficient tensile strength and stiffness and thereby provides the stencil with sufficient tensile strength while allowing it to be smoothly conveyed.

However, the above stencil with the porous resin film 4 has a problem that when relatively thick papers are sequentially fed, their edges contact the same portion of the stencil. This, coupled with the fact that a press roller presses the sheets against the stencil, causes stress to act on the stencil, as stated earlier. This problem will be described more specifically with reference to FIG. 4.

Figure 4:
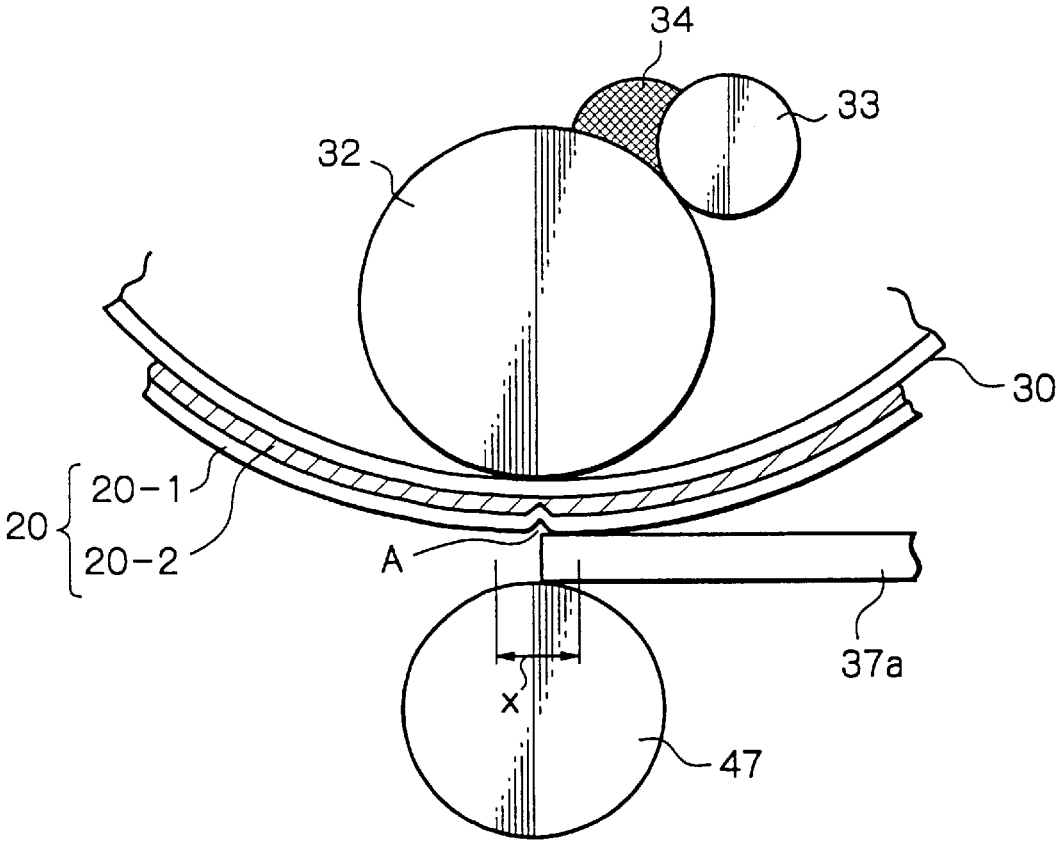
FIG. 4 is an enlarged section showing part of a printing section included in a stencil printer.

As shown in FIG. 4, assume that a relatively thick paper 37*a* belonging to a 110 Kg or heavier class is fed to a print drum 30. A press roller or pressing means 47 presses the leading edge A of the paper 37*a* against the print drum 30 with the intermediary of a stencil 20. The stencil 20 is made up of a thermoplastic resin film 20-1 and a porous resin film 20-2 corresponding to the porous resin film 4.

As the relatively thick papers 37*a* are sequentially fed to the print drum 30, the leading edges or corners A of the papers 37*a* cause stress to repeatedly act on the stencil 20. When the press roller 47 has surface hardness of 25° (JIS -A), the press drum 47 pressed against the print drum 30 forms a nip width x as small as 2 mm to 3 mm. As a result, pressure and therefore stress to act on the stencil 20 is heavy.

The above stress repeatedly acting on the stencil 20 due to the edges A of the consecutive papers 37*a* causes the porous resin film 20-2 with cells to come off the thermoplastic resin film 20-1 although it does not cause the film 20-1 to break. The stencil with the porous resin film or base 20-2 differs from a stencil with a base implemented by flax fibers in that it lacks connection formed by entangled fibers. Therefore, once the porous resin film 20-2 comes off thermoplastic resin 20-1, only the film 20-2 is partly left on the print drum 30 due to the surface tension of ink at the time when the stencil 20 is removed from the print drum 30.

Figure 5:
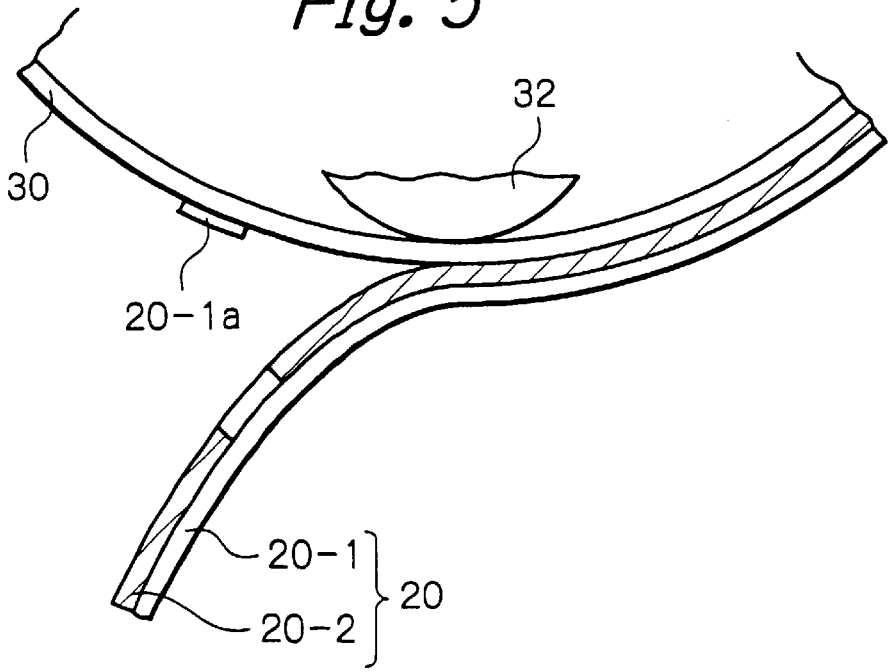
FIG. 5 is a side elevation showing a master removed from a print drum included in the stencil printer.
Figure 6:
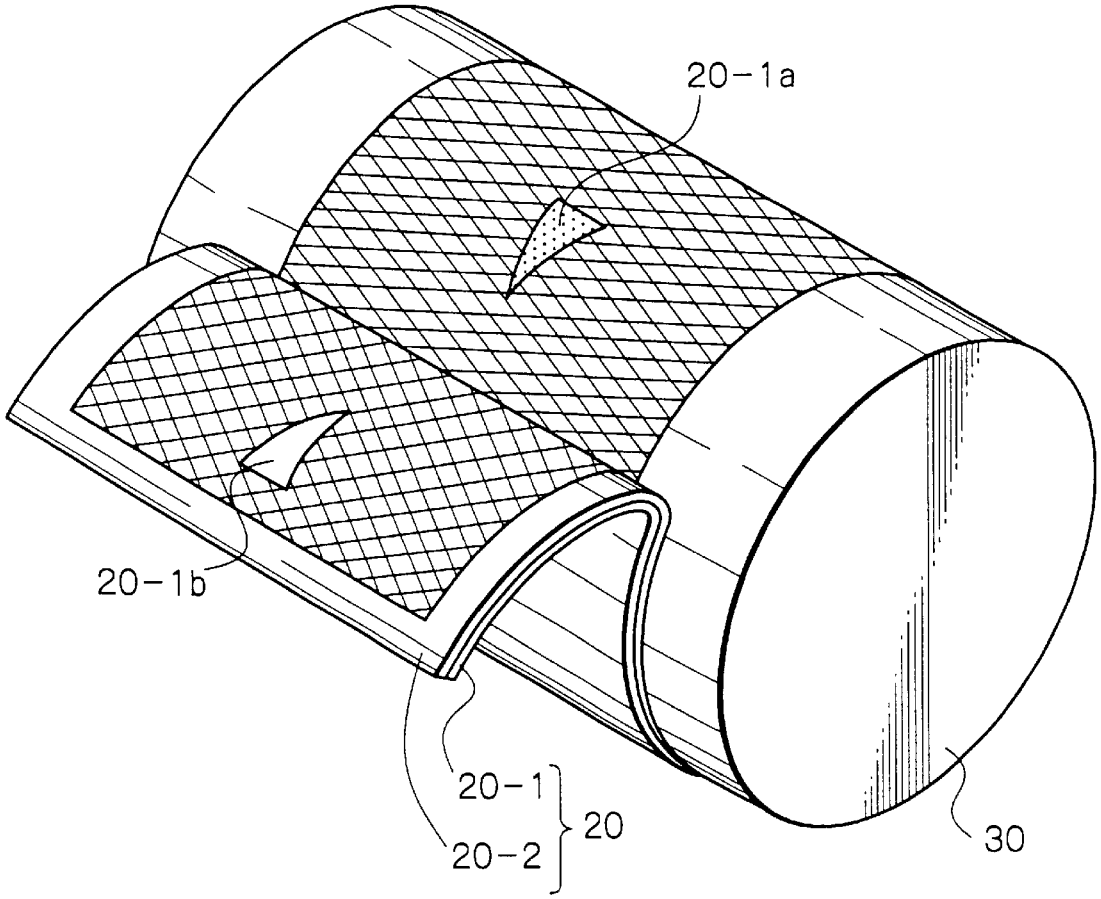
FIG. 6 is an isometric view also showing the master removed from the print drum.

More specifically, as shown in FIGS. 5 and 6, part of the porous resin film 20-2 is left on the print drum 30 in the form of a small piece 20-2*a* when the stencil 20 is removed from the print drum 30. At the same time, a recess 20-2*b* identical in shape with the above piece 20-2*a* is formed in the porous resin film 20-2. Ink is applied to crosshatched areas shown in FIG. 6.

The piece 20-2*a* come off the stencil 20 remains on the print drum 30 even after the used stencil or master 20 is replaced with a new master. At the time of the next printing executed with the new master wrapped around the print drum 30, the piece 20-2*a* left on the print drum 30 blocks ink and thereby causes an image to be locally lost.

In the condition shown in FIG. 4, the porous resin film comes off the thermoplastic resin film when the surface hardness of the press roller 47 is 25°, as stated earlier. In light of this, I conducted experiments with a press roller 47 having surface hardness of 20° or less and relatively thick papers, and found that the nip width x increased to 4 mm to 7 mm. Because the two press rollers 47 different in surface hardness exerted the same pressure, the roller 47 with the surface hardness of 20° reduced the surface pressure acting on the master 20 and therefore the stress acting on the master 20. Consequently, the porous resin film 20-2 was successfully prevented from coming off. By extended researches and experiments, I found particular conditions realizing an attractive image.

Preferred embodiments of the stencil printer in accordance with the present invention will be described hereinafter. First, the general construction of a stencil printer with which the present invention is practicable will be described with reference to FIG. 7. As shown, the stencil printer is generally made up of an image scanning device 10, a master making device 19, a drum unit 29, a press roller or pressing means 47, a paper feeding device or paper feeding means 35, a paper discharging device 56, and a master discharging device 62.

The image scanning device 10 reads an image out of the front surface of a document laid on a glass platen 12 positioned on the top of the device 10. The master making device 19 is arranged below the image scanning device 10 and sequentially perforates, or cuts, a stencil 20 paid out from a roll to thereby form a master. The drum unit 29 is positioned at the center of the printer body and includes a print drum 30 for wrapping the above master, also labeled 20, therearound. The press roller 47 is movable toward and away from the print drum 30 for pressing a paper or similar recording medium 37 against the print drum 30. The paper or medium feeding device 35 is positioned below the master making device 19. The paper feeding device 35 feeds papers 37 stacked on a tray 36 toward a print position one by one. At the print position, the ink drum 30 and press roller 47 contact each other. The paper discharging device 56 is located in the lower portion of the printer body for conveying the paper or print 37 coming out of the print position to a tray 61 with a conveyor belt 59. The master discharging device 62 intervenes between the paper discharging device 56 and the image scanning device 10 for peeling off a used master wrapped around the ink drum 30 and collecting it in a box 70.

The stencil 20 is made up of a thermoplastic resin film 20-1 and a porous resin film 20-2 like the stencil shown in FIG. 4.

The above stencil printer will be operated as follows. First, the operator lays a desired document on the glass platen 12, closes a cover plate 11, and then presses a perforation start key positioned on an operation panel not shown. In response, a used master left on the print drum 30 after the last printing operation is peeled off. Specifically, an upper drive roller 67 and a lower drive roller 68 included in the master discharging device 62 are rotated and, in turn, cause an upper drive roller 65 and a lower drive roller 66 to rotate via an upper rubber belt 63 and a lower rubber belt 64, respectively. At the same time, the print drum 30 is rotated counterclockwise, as viewed in FIG. 7.

As soon as the trailing edge of the stencil approaches the upper driven roller 65, the lower drive roller 66 in rotation is angularly moved about the axis of the upper driven roller 65 until it contacts the print drum 30. The lower driven roller 66 then scoops up the trailing edge of the master and conveys it to the left in cooperation with the upper driven roller 65. The print drum 30 is continuously rotated counterclockwise. The master being conveyed by the two driven rollers 65 and 66 moves between the upper and lower rubber belts 63 and 64 to the upper and lower drive rollers 67 and 68. The two drive rollers 67 and 68 cooperate to drive the master into the box 70 positioned downstream of the drive roller 67 and 68. After the entire master has been received in the box 70, a flat compressor 69 is lowered to compress the master in the box 70. The compressor 69 compressed the master is again raised to a preselected home position and stopped there. Also, the lower driven roller 66 is returned to its home position. Subsequently, the drive rollers 67 and 68 are caused to stop rotating.

In parallel with the above master discharging step, the image scanning device or reduction type optics 10 scans the document laid on the glass platen 12. Specifically, while a light source 13 illuminates the document, the resulting reflection from the document is routed through a first mirror 14, a second mirror 15, a third mirror 16 and a lens 17 to a CCD (Charge Coupled Device) image sensor or similar image pickup device 18. The image pickup device 18 transforms the incident reflection to an electric image signal. An image processing unit, not shown, digitizes the image signal and sends the resulting digital image signal to the master making device 19.

A thermal head 22 has a plurality of heat generating elements arranged in an array. The master making device 19 causes the heat generating elements to selectively generate heat in accordance with the above digital image signal, thereby selectively perforating the stencil 20 pressed against the head 22 by a platen roller 21. The platen roller 21 conveys the stencil 21 to the left, as viewed in FIG. 7, while rotating in synchronism with the image signal.

In the above condition, a pair of reverse rollers 27 and 28 nip the leading edge of the stencil 20 being perforated by the head 22. As a result, the perforated part of the stencil 20 is accommodated in a box 25 in the form of a loop. A fan 26 is disposed in the box 25 for sucking the stencil 20 into the box 25 while cooling it off.

Figure 7:
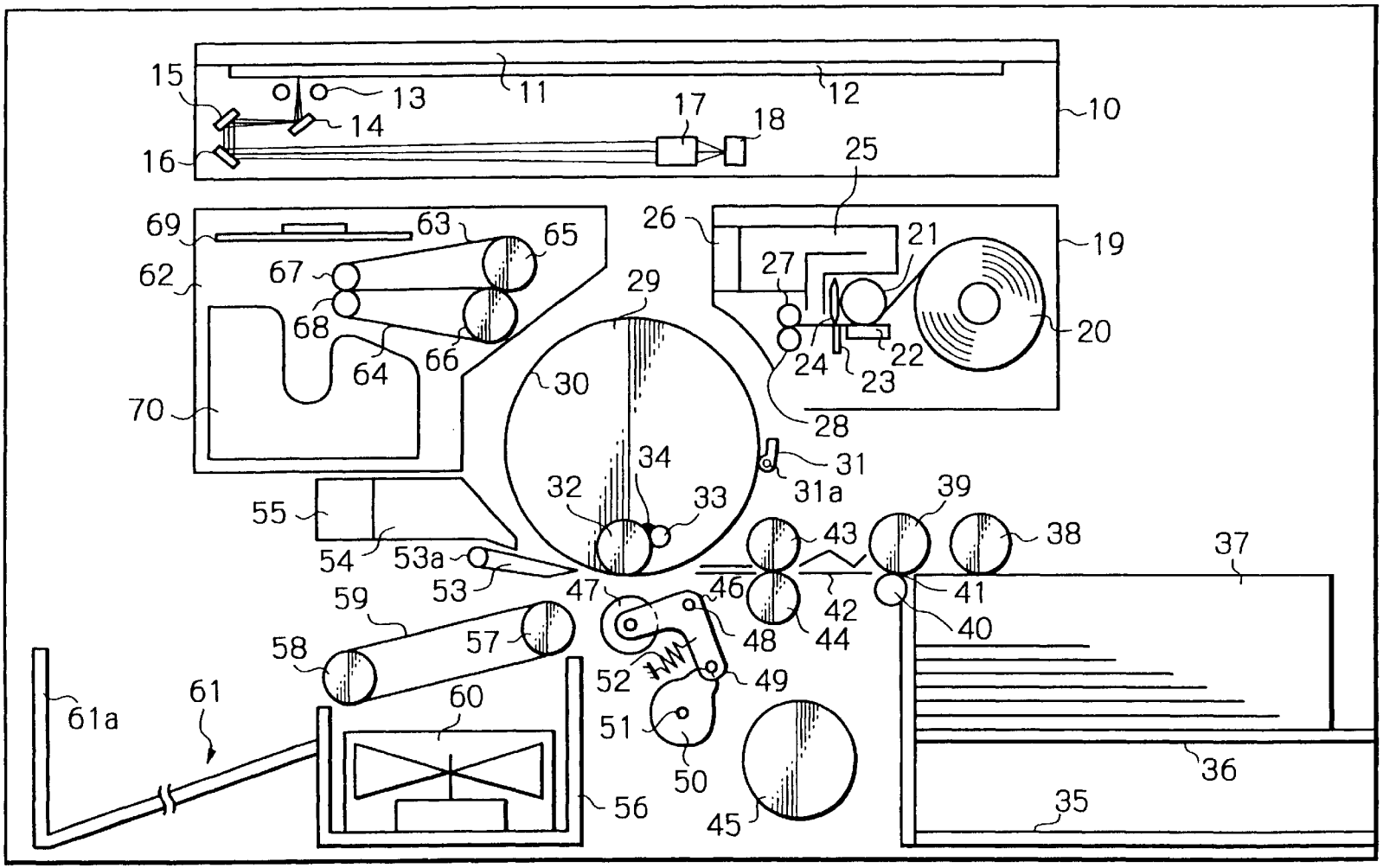
FIG. 7 is a view showing the general construction of a stencil printer to which the present invention is applicable.

After the master discharging step, the print drum 30 is brought to a stop at a preselected position shown in FIG. 7. Subsequently, a damper 31 mounted on the outer periphery of the print drum 30 is opened by a driving device, not shown, in order to clamp the leading edge of the stencil 20.

After the opening of the damper 31, the reverse rollers 27 and 28 start rotating. As a result, the perforated part of the stencil 20 received in the box 25 in the form of a loop is sequentially paid out from the box 25 toward the damper 31. At a preselected time when the leading edge of the stencil 20 reaches the damper 31, the damper 31 is closed to clamp it. The print drum 30 is then rotated counterclockwise, as viewed in FIG. 7, sequentially wrapping the stencil 20 therearound.

After a single master has been formed in the stencil 20, a cutter made up of a rotary edge 24 and a stationary edge 23 cuts the stencil 20 at a preselected length to thereby produce a master 20.

The print drum 30 is continuously rotated clockwise even after the master 20 has been fully wrapped around the drum 30. In this condition, a pickup roller 38 and a feed roller 39 are rotated clockwise, as viewed in FIG. 7, in order to pay out the top paper 37 from the tray 36 toward a nip between a pair of registration rollers 43 and 44 via a guide 42. The registration rollers 43 and 44 start conveying the paper 37 to the print position between the press drum 30 and the press roller 47 at a preselected timing synchronous to the rotation of the drum 3.

The press roller 47 is rotatably supported by one end of an arm 46 that is, in turn, rotatably supported by a shaft 48. The press roller 47 is therefore angularly movable about the shaft 48 and is spaced from the print drum 30 until the paper 37 arrives at the print position, as illustrated. A cam follower 49 is mounted on the other end of the arm 46 and held in contact with a cam 50 rotatable about a shaft 51 in synchronism with the print drum 30.

When the registration rollers 34 and 35 drive the paper 37 toward the print position, the cam 50 and cam follower 49 cooperate to raise the press roller 47 at a preselected timing. The press roller 47 presses the master wrapped around the print drum 30 against the outer periphery of the drum 30 via the paper 37. As a result, the master is caused to closely adhere to the print drum 30 due to ink existing on the outer periphery of the drum 30. Subsequently, a peeler 53 removes the paper 37 from the master. The conveyor belt 59 conveys the removed paper 37 to the tray 61. This operation for causing the mater to adhere to the print drum 30 may be repeated a plurality of times.

Subsequently, the operator inputs a desired number of prints on the operation panel and presses a print start key. In response, the print drum 30 starts rotating clockwise, as viewed in FIG. 7, while the pickup roller 38 and upper feed roller 39 start rotating clockwise, as viewed in FIG. 7, at a preselected timing. The upper feed roller 39, a lower feed roller 40 and a loosening plate 41 cooperate to pay out the top paper 37 from the tray 36 toward the registration rollers 43 and 44, which is stationary at this time, via the guide 42. At the previously mentioned preselected timing, the registration rollers 43 and 44 drive the paper 37 toward the print position between the print drum 30 and press roller 47.

The cam 50 and cam follower 49 cooperate to raise the press roller 47 about the shaft 48 at a preselected timing. The press roller 47 then presses the paper 37 against the mater wrapped around the print drum 30 by the previously stated procedure. The press roller 47 has a surface formed of rubber and is rotatably supported by the arm 46. The press roller 47 is therefore caused to rotate by the print drum 30 via the paper 37 at the peripheral speed of the drum 30. A tension spring 52 is loaded between the arm 46 and a stationary member included in the printer body and constantly biases the press roller 47 toward the print drum 30.

As the print drum 30 is further rotated with the press roller 47 pressing the paper 37 against the master, ink is transferred from the inside of the print drum 30 to the paper 37 via the perforations of the master 20. Specifically, an ink feeding device is arranged in the print drum 30 and includes an ink roller 32 and a doctor roller 33. The ink roller 32 is rotated in the same direction as the print drum 30 at a preselected peripheral speed relative to the peripheral speed of the drum 30. The ink roller 32 and doctor roller 33 form a generally wedge-shaped ink well 34 therebetween. The ink is fed from the ink well 34 to the inner periphery of the print drum 30 while being regulated by a preselected gap between the two rollers 32 and 33.

The print drum 30 consists of a porous thin metallic sheet implemented as a hollow cylinder and one or more mesh screens laminated on the cylinder, although not shown specifically. The master is wrapped around the outermost mesh screen. Therefore, the ink fed to the inner periphery of the print drum 30, i.e., the porous thin sheet by the ink roller 32 is passed through the pores of the sheet and then spread in the mesh screens. The ink is then uniformly scattered by the porous resin film of the master and brought to the paper 37 via the perforations formed in the film of the master, printing an image on the paper 37.

The print drum 30 in rotation moves the paper 37 to the left, as viewed in FIG. 7, toward the paper discharging device 56. At this instant, the peeler 53 and an air knife 54 cooperate to separate the paper 37 from the master. Specifically, the peeler 53 is rotatable about a shaft 53*a* and driven at a preselected timing so as not to interfere with the damper 31 of the print drum 30. The edge of the peeler 53 is selectively movable between a position where it is close to the print drum 30 and a position where it is remote from the drum 30. The air knife 54 is implemented by an air knife fan 55 and a duct and sends air from a position above the peeler 53 toward the edge of the peeler 53, i.e., toward the upper surface of the paper 37.

A suction fan 60 sucks the paper 37 onto the conveyor belt 59 conveying the paper 37 to the left, as viewed in FIG. 7. The conveyor belt 59 is passed over a drive roller 58 and a driven roller 57. The drive roller 58 rotates counterclockwise, as viewed in FIG. 7, for causing the conveyor belt 59 to run at a higher peripheral speed than the print drum 30. Therefore, when the trailing edge of the paper 37 moves away from the print position, the movement of the paper 37 is accelerated due to the above peripheral speed of the conveyor belt 59. Consequently, the paper or print 37 is driven out of the printer body to the tray 61 via a position above the drive roller 58. On the tray 61, the leading edge of the print 37 hits against an end guide 61a and then drops due to its own weight to be neatly stacked on the tray 61.

The above printing cycle is repeated until the desired number of prints have been stacked on the tray 61. Thereafter, the print drum 30 is again brought to a stop at the preselected position.

The stencil printer is caused to perform the above operation by drive sources including a main motor 45, drive mechanisms associated therewith, and a control unit not shown.

1st Embodiment

Figure 8:
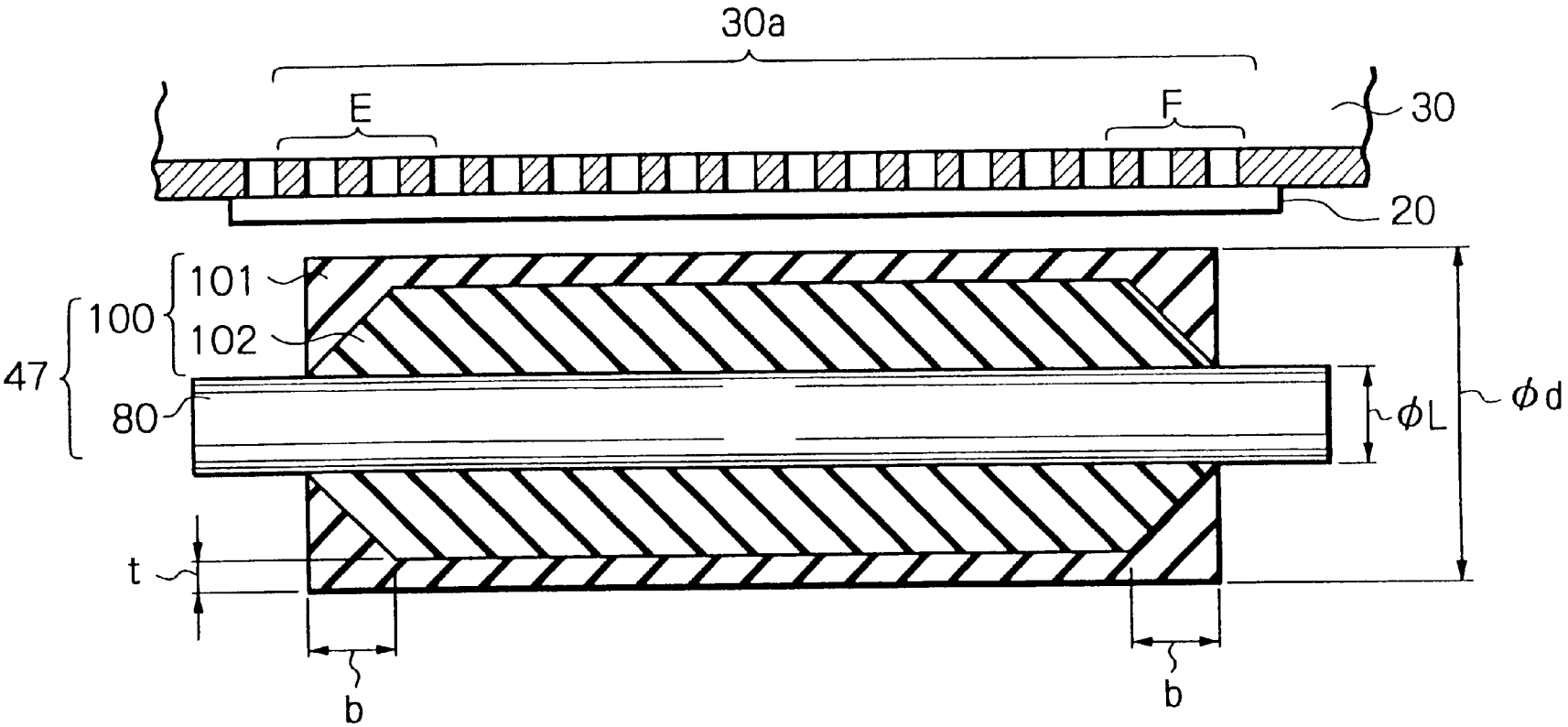
FIG. 8 is a section of a press roller included in the stencil printer of FIG. 7.

As shown in FIG. 8, in a first embodiment of the present invention, the press roller 47 consists of a metallic core 80 and a rubber portion 100 covering the core 80. The rubber portion 100 is made up of an inner rubber layer 102 contacting the core 80 and an outer rubber layer 101 surrounding the inner rubber layer 102. In the illustrative embodiment, the core 80 has a diameter $\phi L$ of 8 mm to 16 mm. The outer rubber layer 101 and therefore the press roller 47 has an outside diameter $\phi d$ of 20 mm to 50 mm. The core 80 is freely rotatably supported by the arm 46. If desired, the rubber portion 100 may be implemented by a single rubber layer or three or more rubber layers.

Why the rubber portion 100 of the illustrative embodiment has two or more rubber layers is as follows. Basically, the hardness of the rubber portion 100 should preferably be as low as possible in order to increase the nip width x, FIG. 4, so that the surface pressure to act on the stencil 20 including the porous resin film 20-2 can be reduced to scatter stress. However, to lower the hardness, it is necessary for the rubber to contain a great amount of oil and be vulcanized and molded. Vulcanization renders the surface of the rubber portion 100 sticky or soft with the result that the surface area of the rubber portion 100 increases at the time of finishing as if the surface were picked off. Consequently, when a thin paper, for example, is used, it sticks to the surface of the press roller 47 and rolls up. To solve this problem, the rubber portion 100 is provided with a plurality of layers the outermost one of which has hardness free from picking or stickiness.

Specifically, the outer rubber layer 101 is formed of a material having higher hardness than the material of the inner rubber layer 102. With this structure, the surface of the rubber portion 100 is free from stickiness and can be finely finished without being picked off, obviating the adhesion of thin papers to the press roller 47. In the illustrative embodiment, to prevent the porous resin film 20-2 from coming off by lowering the hardness as far as possible, the inner rubber layer 102 and outer rubber layer 101 are provided with hardness of 8° to 14° (JIS-A) and hardness of 30° to 40° (JIS-A), respectively.

Experiments were conducted to determine the degree of come-off of the porous resin film 20-2 by varying the thickness t of the outer rubber layer 101 and thereby varying the surface hardness of the rubber layer 101, i.e., the surface hardness of the roller itself. The thick paper 37*a*, FIG. 4, was used as the paper 37. While a press roller with surface hardness of 5° (JIS-a) was also prepared, it failed to have an accurate diameter. The minimum necessary hardness was therefore determined to be 7° to 8°. For the experiments, use was made of a stencil printer PREPORT JP1300 available from Ricoh Co., Ltd. and papers of A6 size belonging to the 180 kg class generally considered to exert the heaviest stress on the stencil 20.

The paper 37 may even be an envelope having some papers laminated at its opposite ends and therefore thicker than the thick paper 37*a* at its opposite ends. This brings about a problem that when 1,000 to 2,000 envelopes are passed, not only the porous resin film 20-2 but also the thermoplastic resin film 20-1 of the stencil 20 break. In light of this, the breakage of the thermoplastic resin film 20-1 ascribable to the edges of envelopes was also examined in addition to the come-off of the porous resin film 20-2. The results of experiments are shown in FIG. 9.

In FIG. 9, "Surface Rubber Hardness" refers to the measured hardness of the surface of the outer layer implemented as part of the roller while "Rubber Hardness (Inner)" and "Rubber hardness (Outer)" respectively refer to the hardness of the materials of the inner and outer layers measured alone. Crosses, circles and double circles shown in FIG. 9 respectively indicate "come-off", "no come-off" and "no come off and no breakage". Further, starts indicate that neither come-off nor breakage occurred even when 5,000 papers were passed.

As FIG. 9 indicates, when the hardness was 20° or less (JIS-A), the porous resin film 20-2 did not come off despite the stress ascribable to the edges A of thick papers. To have surface hardness of 20° or less and prevent papers from rolling up, the thickness t of the outer rubber layer 101 should range from 0.3 mm to 1.0 mm. Even envelopes did not break the thermoplastic resin film 20-1 when the surface hardness was 18° or less (JIS-A), although the film 20-1 was broken when about 2,000 envelopes were passed. However, when the surface hardness was less than 15° (JIS-A), the above film 20-1 did not break even when 5,000 envelopes were passed.

The porous resin film 20-2 came off when the above experiments were conducted with a press roller having a single rubber layer (hardness of 25° (JIS-A)) included in the stencil printer PREPORT.

On the other hand, as FIG. 9 also indicates, the surface pressure decreases with a decrease in hardness and therefore degrades the ability of the roller to force out the ink from the inside of the print drum 30. Particularly, as shown in FIG. 8, boundary portions E and F between a perforated portion 30*a* and a non-perforated portion have higher rigidity than the perforated portion 30*a*, so that the above ability is further degraded. That is, the ability of the press roller 47 to force out the ink from the inside of the print drum 30 falls at axially opposite end portions thereof, bringing about another cause of local omission of an image and preventing the effective image width from being guaranteed.

In the illustrative embodiment, the outer rubber layer 101 with high hardness is thickened over the ranges b of the rubber portion 100 corresponding to the above boundary portions E and F. More specifically, at axially opposite end portions of the press roller 47, the outer rubber layer 101 is sequentially increased in thickness toward the opposite ends while the inner rubber layer 102 is sequentially reduced in thickness complementarily to the outer rubber layer 101. With this configuration, it is possible to increase the rubber hardness of the press roller 47 at the boundary portions E and F and therefore the surface pressure to act on the print drum 30. This is successful to force out the ink from the inside of the print drum 30 at the opposite end portions in the same manner as at the center portion, thereby guaranteeing the effective image width.

In practice, the ranges b shown in FIG. 8 should preferably be 5 mm to 15 mm long each. If the ranges b exceed such a dimension and if the thick paper 37*a* is relatively wide, the opposite ends of the press roller 47 with increased rigidity press the paper 37*a* and are likely to cause the porous resin film 20-2 to come off.

As for the material of the inner and outer rubber layers 102 and 101, use may be made of silicone rubber, urethane rubber, chloroprene rubber, nitrile rubber, ethylene-propylene rubber (EPDM), butadien rubber, and styrene-butadien rubber. To produce the press roller 47, after the inner rubber layer 102 has been vulcanized and molded, adhesive is applied to the surface of the rubber layer 102. Subsequently, the outer rubber layer 101 is vulcanized and molded and has its outer circumference finished.

Every time a paper 37 arrives at the print position, the press roller 47 is pressed against the print drum 30 and rotated by the print drum 30. Therefore, before the arrival of the next paper 37, the press roller 47 is released from the print drum 30 and rotates at a lower peripheral speed of the print drum 30. On the arrival of the next paper 37, the press roller 47 rotating at the above low peripheral speed is again pressed against the print drum 30. At this instant, the press roller 47 is apt to pull the master 20 wrapped around the print drum 30 to the downstream side due to the difference in peripheral speed and stretch or even pulls the master 20 out of the damper 31.

To solve the above problem, a film of tetrafluoro resin, e.g., Teflon (trade name) may be formed on the surface of the outer rubber layer 101 at low temperature so as to reduce the coefficient of friction of the surface. This film allows the surface of the press roller 47 to slide on the master 20 and does not exert stress that would stretch or pull the master 20 out of the damper 31.

2nd Embodiment

In the previous embodiment, to obviate the come-off of the porous resin film 20-2, the hardness is reduced by implementing the two rubber layers 101 and 102 with a solid material. In this embodiment, as shown in FIG. 10B, a press roller 47' has foam 104 covering the metallic core 80. The foam 104 is implemented by urethane foam having inherently low residual compressive strain. More specifically, as for residual compressive strain, use was made of foam varying in thickness by less than 0.15% to 20% when compressed to 50% at 70° C. for 22 hours and then left at room temperature for 30 minutes in accordance with JIS-K6401. The thick paper 37*a*, FIG. 4, of size A6 and belonging to the 160 kg class was used as the paper 37.

Even when images were printed on 5 million papers 37*a* under the above conditions, the outside diameter ϕd of the press roller 47' did not decrease over the range corresponding to the size of the small papers 37*a*. Therefore, when images were printed on ordinary papers, there was obviated an occurrence that an image was locally lost due to the local decrease in diameter ϕd. This was proved by the fact that when 5 million thick papers of size A6 and belonging to the 180 kg class were passed through PREPORT, the outside diameter of the foam 104 did not vary, and image density was not lowered.

For the durability tests, use were made of a microcell roll ENDUR-CHG (trade name) available form Inoac and ZULEN XCK (trade name) available from BRIDGESTONE CORP. The foam 104 had hardness of 20° to 20° (Ascar C). Ascar C is a hardness tester for foam and includes a testing member having a greater diameter than the testing member of the JIS-A standard and exerting lower pressure; the above hardness was 7° to 12° in accordance with the JIS-A scale.

The press roller 47 whose foam 104 satisfied the surface hardness of 20° or less (JIS-A) alone was mounted on PREPORT in order to determine whether or not the porous resin film 202 came off due to the edges of thick papers. It was found that the film 202 did not come off because of the hardness of 20° or less.

Assume that ink deposits on the surface of the press roller 47' having only the foam 104 due to mishandling. Then, the ink enters holes appearing on the surface of the foam 104 and smears the rear surfaces of the papers. If the surface of the press roller is implemented by solid rubber, then the ink inadvertently deposited on the roller will disappear when a few papers are passed. However, the ink entered the holes of the foam 104 penetrates into cell contiguous with the holes and smears the rear surfaces of more than twenty consecutive papers.

Figure 10A:
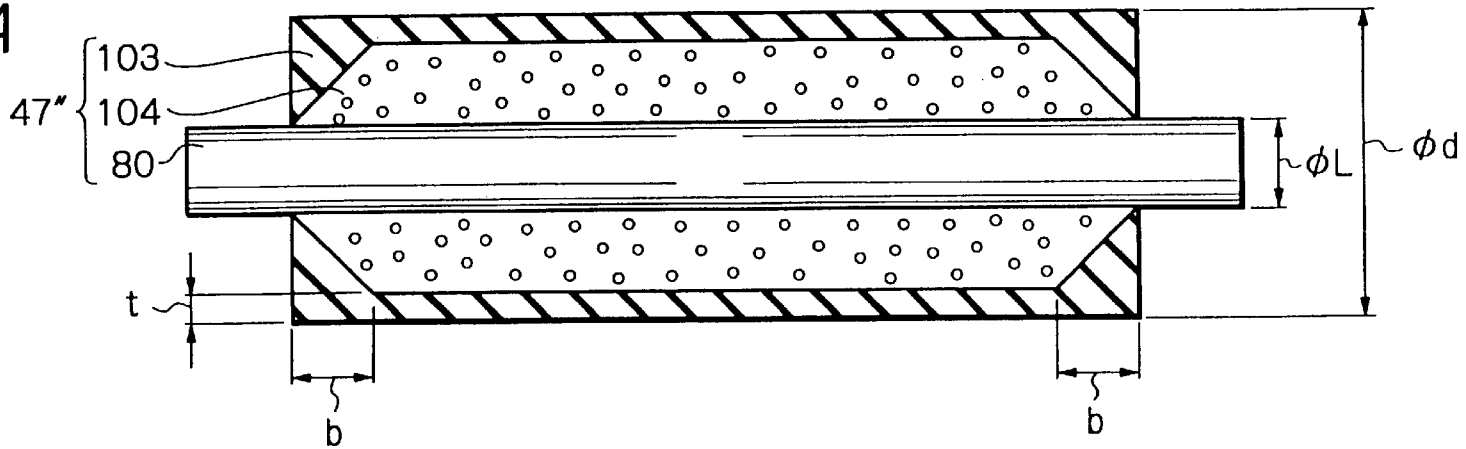
FIGS. 10A and 10B are sections each showing a particular specific configuration of the press roller.
Figure 10B:
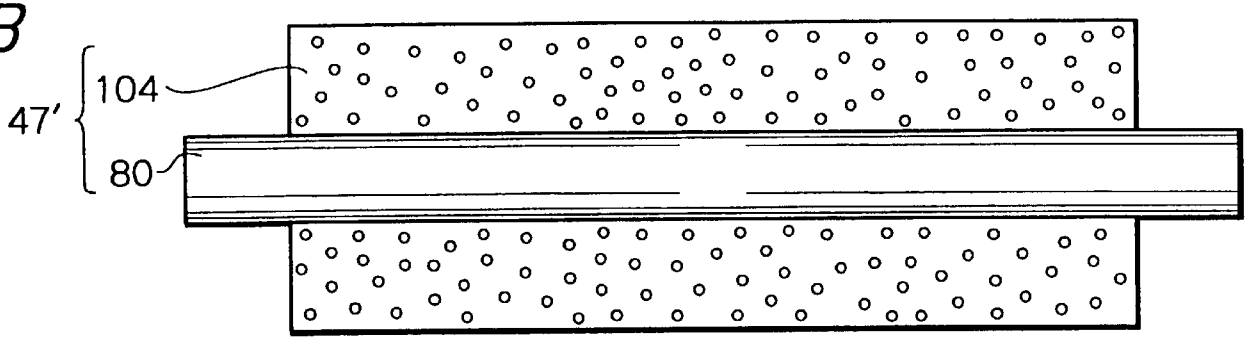

FIG. 10A shows a press roller 47" additionally including a solid rubber layer or non-foam elastic layer 103 formed on the surface of the foam 104 by vulcanization and molding. The solid rubber layer 103 fills the holes appearing the surface of the foam 104 and therefore causes the ink inadvertently deposited on the press roller 47" to disappear when only a few papers are passed. Particularly, when the rubber layer 103 is implemented by silicone rubber, it satisfies an internal plastics combustibility standard UL-V which is one of safety standards.

More specifically, the press roller 47' having only the foam 104 cannot satisfy the above safety standard UL-V2 and must have the foam 104 surrounded by sheet metal at the sacrifice of the cost. The press roller 47" with the rubber layer 103 covering the foam 104 clears the safety standard without resorting to sheet metal and obviates a bulky configuration.

Again, at axially opposite end portions of the press roller 47", the rubber layer 103 is sequentially increased in thickness toward the opposite ends while the foam 104 is sequentially reduced in thickness complementarily to the rubber layer 103, as in the configuration shown in FIG. 8. With this configuration, it is possible to increase the rubber hardness of the press roller 47" at the boundary portions E and F and therefore the surface pressure to act on the print drum 30, as stated with reference to FIG. 8. This is successful to force out the ink from the inside of the print drum 30 at the opposite end portions in the same manner as at the center portion, thereby guaranteeing the effective image width. In this case, the ranges b should preferably be 8 mm to 16 mm long each. The core 80 has a diameter ϕL of 8 mm to 16 mm while the rubber layer 103 and therefore the press roller 47" has an outside diameter ϕd of 20 mm to 50 mm. Experimental results obtained with PREPORT under the same conditions as in FIG. 9 are shown in FIG. 11.

In FIG. 11, "Surface Rubber Hardness" refers to the measured hardness of the surface implemented as part of the roller while "Foam Hardness" and "Rubber hardness (Outer)" respectively refer to the hardness of the materials of the foam and rubber layer measured alone. Again, crosses, circles and double circles shown in FIG. 11 respectively indicate "come-off", "no come-off" and "no come off and no breakage". Further, starts indicate that neither come-off nor breakage occurred even when 5,000 papers were passed.

As FIG. 11 indicates, the thickness of the rubber layer 103 should preferably be 0.3 mm to 1.0 mm. The rubber layer 103 with thickness of 0.3 mm or above sufficiently prevents ink from penetrating into the roller.

It was experimentally found with the press roller 47" that when the foam 104 and rubber layer 103 respectively had hardness of 20° to 30° (Ascar C) and hardness of 30° to 40° (JIS-A), the hardness of 20° (JIS-A) obviating the come-off of the porous resin film 20-2 could be achieved.

Even envelopes did not break the thermoplastic resin film 20-1 when the surface hardness was 18° (JIS-A) or less, although the film 20-1 was broken when about 2,000 envelopes were passed. However, when the surface hardness was less than 15° (JIS-A), the above film 20-1 did not break even when 5,000 envelopes were passed.

3rd Embodiment

In the second embodiment, the press roller 47" is produced by causing the foam 104 to foam, applying the rubber layer 103 to the foam 104, and then vulcanizing the rubber layer 103. This, however, cannot be done without two different molds or vulcanization and heating effected separately from each other. As a result, the foam 104 and rubber layer 103 need two different steps each and increase the cost of the press roller 47".

Figure 12:
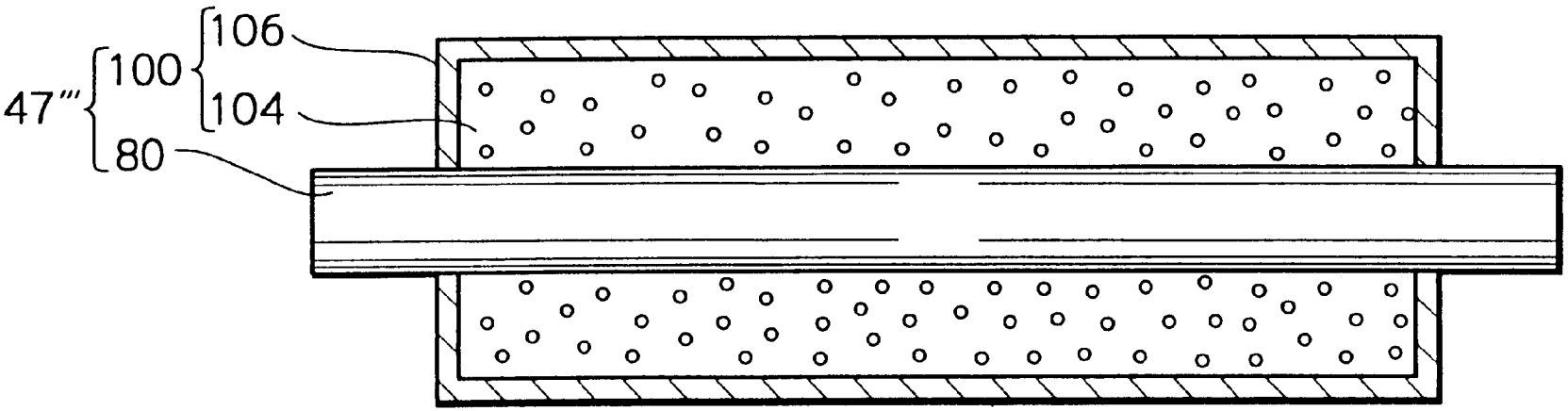
FIG. 12 is a section showing another specific configuration of the press roller.

As shown in FIG. 12, in a third embodiment of the present invention, a press roller 47'" has a foam layer and an ink blocking film formed thereon by a single molding step. For the press roller 47'", use was made of silicone rubber available from Shin-Etsu Chemical Co., Ltd. Briefly, to produce the press roller 47'", silicone rubber prepared by mixing an agent to turn out foam with silicone is introduced into a mold and then heated. Heat causes part of the silicone rubber to form the roller-like foam 104 in the inner portion of the mold and causes the other part of the silicone rubber contacting the mold and unable to foam by being pressed by the above part to form a thin skin layer 106 on the foam 104. The skin layer 106 is not permeable to ink and covers the outer periphery of the foam 104, i.e., the circumferential surface and opposite end faces of the press roller 47'''. In this manner, the press roller 47''' is formed by a single molding step.

Again, as for residual compressive strain, use was made of foam varying in thickness by less than 0.15% to 20% when compressed to 50% at 70° C. for 22 hours and then left at room temperature for 30 minutes in accordance with JIS-K6401. This embodiment achieved the same experimental results as the previous embodiments and successfully prevented the porous resin film 20-2 from coming off.

4th Embodiment

Each of the press rollers 47'' and 47''' has its surface treated at low temperature for forming a film included in the first embodiment on the rubber layer. The film serves to lower the coefficient of friction of the above surface.

In summary, it will be seen that the present invention provides a stencil printer having various unprecedented advantages, as enumerated below.

(1) As for a stencil having a porous resin film as a base, the resin film is prevented from coming off due to stress ascribable to the edges of thick papers. This obviates the local omission of an image.

(2) The resistance of the stencil to printing is enhanced.

(3) Even when the surface hardness of a roller is lowered, the surface of the roller is free from stickiness and picking and therefore prevents a paper from sticking thereto and rolling up.

(4) The surface hardness of the roller is selected to be 18° or less (JIS-A). The roller can therefore obviate both of the come-off of the resin film and the roll-up of a paper.

(5) An effective image width is guaranteed even when the surface hardness of the roller is lowered.

(6) Foam included in the roller does not decrease in diameter even when repeatedly pressed against a print drum. This is also successful to obviate the local omission of an image.

(7) A layer formed on the foam prevents ink from penetrating into the foam and substantially frees the rear surfaces of papers from smears.

(8) Even the roller with the above foam and layer covering it obviates the come-off of the resin film and the roll-up of a paper.

(9) The foam and layer covering it guarantee the effective image width even despite that the surface hardness is lowered.

(10) The layer covering the foam is implemented by silicone rubber, so that the press roller satisfies the safety standard UL-V2.

(11) The roller is easy to produce.

(12) The roller prevents a master wrapped around the print drum from slipping out of a damper or stretching.

Various modifications will become possible for those skilled in the art after receiving the teachings of the present disclosure without departing from the scope thereof.

What is claimed is:

1. A stencil printer comprising:

a porous hollow cylindrical print drum rotatable with a perforated master having a porous resin film as a base wrapped around said print drum;

pressing means selectively movable into or out of contact with said print drum for pressing a recording medium fed from medium feeding means against said print drum, whereby ink is transferred from an inside of said print drum to said recording medium via perforations formed in the master;

wherein said pressing means comprises a roller having a surface hardness of 18° or less (JIS-A).

2. A stencil printer as claimed in claim 1, wherein said roller comprises a metallic core and a plurality of layers laminated on said core and each having a particular hardness, one of said plurality of layers forming a surface of said roller having a highest hardness.

3. A stencil printer as claimed in claim 2, wherein said plurality of layers comprise an inner layer having a hardness of 8° to 14° (JIS-A) as a single material and an outer layer having a hardness of 30° to 40° (JIS-A) as a single material and a thickness of 0.3 mm to 1 mm.

4. A stencil printer as claimed in claim 2, wherein said plurality of layers comprises an outer layer having axially opposite end portions sequentially increasing in thickness toward opposite ends, and an inner layer having axially opposite end portions decreasing in thickness toward opposite ends complementarily to said outer layer.

5. A stencil printer as claimed in claim 1, wherein said roller is formed of a foam having a thickness varying, with respect to residual compressive strain, by less than 0.5% to 20% when compressed to 50% at 70° C. for 22 hours and then left at room temperature for 30 minutes in accordance with JIS-K6401.

6. A stencil printer as claimed in claim 5, wherein a non-foam elastic layer covers said foam.

7. A stencil printer as claimed in claim 6, wherein said foam has a hardness of 20° to 30° (Ascar C) as a single material while said layer covering said foam has a thickness of 0.3 mm to 1 mm and a hardness of 30° to 40° (JIS-A) as a single material.

8. A stencil printer as claimed in claim 6, wherein said non-foam elastic layer covers a circumferential surface and axially opposite end faces of said foam and has axially opposite end portions sequentially increasing in thickness toward opposite ends, said foam having axially opposite end portions sequentially decreasing in thickness toward opposite ends complementarily to said non-foam elastic layer.

9. A stencil printer as claimed in claim 6, wherein said non-foam elastic layer comprises silicone rubber.

10. A stencil printer as claimed in claim 5, wherein said roller comprises an inner layer formed of foamed silicone rubber and an outer layer implemented by a skin layer having a same composition as said foamed silicone rubber, said outer layer covering a circumferential surface and axially opposite end faces of said roller.

11. A stencil printer as claimed in claim 5, wherein said roller has an outer layer whose surface is treated to lower a coefficient of friction.

12. A stencil printer comprising:

a porous hollow cylindrical print drum rotatable with a perforated master having a porous resin film as a base wrapped around said print drum;

pressing means selectively movable into or out of contact with said print drum for pressing a recording medium fed from medium feeding means against said print drum, whereby ink is transferred from an inside of said print drum to said recording medium via perforations formed in the master;

wherein said pressing means comprises a roller having a surface hardness of less than 15° (JIS-A).

13. A stencil printer as claimed in claim 12, wherein said roller comprises a metallic core and a plurality of layers laminated on said core and each having a particular hardness, one of said plurality of layers forming a surface of said roller having a highest hardness.

14. A stencil printer as claimed in claim 13, wherein said plurality of layers comprise an inner layer having a hardness of 8° to 14° (JIS-A) as a single material and an outer layer having a hardness of 30° to 40° (JIS-A) as a single material and a thickness of 0.3 mm to 1 mm.

15. A stencil printer as claimed in claim 13, wherein said plurality of layers comprises an outer layer having axially opposite end portions sequentially increasing in thickness toward opposite ends, and an inner layer having axially opposite end portions decreasing in thickness toward opposite ends complementarily to said outer layer.

16. A stencil printer as claimed in claim 12, wherein said roller is formed of a foam having a thickness varying, with respect to residual compressive strain, by less than 0.5% to 20% when compressed to 50% at 70° C. for 22 hours and then left at room temperature for 30 minutes in accordance with JIS-K6401.

17. A stencil printer as claimed in claim 16, wherein a non-foam elastic layer covers said foam.

18. A stencil printer as claimed in claim 17, wherein said foam has a hardness of 20° to 30° (Ascar C) as a single material while said layer covering said foam has a thickness of 0.3 mm to 1 mm and a hardness of 30° to 40° (JIS-A) as a single material.

19. A stencil printer as claimed in claim 17, wherein said non-foam elastic layer covers a circumferential surface and axially opposite end faces of said foam and has axially opposite end portions sequentially increasing in thickness toward opposite ends, said foam having axially opposite end portions sequentially decreasing in thickness toward opposite ends complementarily to said non-foam elastic layer.

20. A stencil printer as claimed in claim 17, wherein said non-foam elastic layer comprises silicone rubber.

21. A stencil printer as claimed in claim 16, wherein said roller comprises an inner layer formed of foamed silicone rubber and an outer layer implemented by a skin layer having a same composition as said foamed silicone rubber, said outer layer covering a circumferential surface and axially opposite end faces of said roller.

22. A stencil printer as claimed in claim 12, wherein said roller has an outer layer whose surface is treated to lower a coefficient of friction.

23. A stencil printer comprising:

a porous hollow cylindrical print drum rotatable with a perforated master having a porous resin film as a base wrapped around said print drum;

a pressing member selectively movable into or out of contact with said print drum and constructed to press a recording medium fed from a medium feeding device against said print drum, whereby ink is transferred from an inside of said print drum to said recording medium via perforations formed in the master;

wherein said pressing member comprises a roller having a surface hardness of 18° or less (JIS-A).

24. A stencil printer comprising:

a porous hollow cylindrical print drum rotatable with a perforated master having a porous resin film as a base wrapped around said print drum;

a pressing member selectively movable into or out of contact with said print drum and constructed to press a recording medium fed from a medium feeding device against said print drum, whereby ink is transferred from an inside of said print drum to said recording medium via perforations formed in the master;

wherein said pressing member comprises a roller having a surface hardness of less than 15° (JIS-A).

* * * * *

UNITED STATES PATENT AND TRADEMARK OFFICE

CERTIFICATE OF CORRECTION

PATENT NO. : 6,389,964 B1
DATED : May 21, 2002
INVENTOR(S) : Eiji Ohkawa

It is certified that error appears in the above-identified patent and that said Letters Patent is hereby corrected as shown below:

Column 4,
Line 50, change “cell,” to -- cells, --.

Column 8,
Lines 56, 59 and 62, change “damper” to -- clamper --;
Line 64, change “damper 31, the damper 31” to -- clamper 31, the clamper 31 --.

Column 10,
Line 22, change “damper” to -- clamper --.

Column 12,
Line 64, change “damper” to -- clamper --.

Column 13,
Line 4, change “damper” to -- clamper --.

Column 15,
Line 59, change “damper” to -- clamper --.

Signed and Sealed this

Eighteenth Day of February, 2003

JAMES E. ROGAN
*Director of the United States Patent and Trademark Office*